US008180252B2

(12) United States Patent
Itabashi

(10) Patent No.: US 8,180,252 B2
(45) Date of Patent: May 15, 2012

(54) PHOTOSENSITIVE BODY FOR ELECTRO-PHOTOGRAPHY

(75) Inventor: Nao Itabashi, Nagoya (JP)

(73) Assignee: Brother Kogyo Kabushi Kaisha, Aichi-ken (JP)

( * ) Notice: Subject to any disclaimer, the term of this patent is extended or adjusted under 35 U.S.C. 154(b) by 181 days.

(21) Appl. No.: 12/505,113

(22) Filed: Jul. 17, 2009

(65) Prior Publication Data

US 2010/0021206 A1 Jan. 28, 2010

(30) Foreign Application Priority Data

Jul. 25, 2008 (JP) ..... 2008-191574

(51) Int. Cl.
*G03G 15/00* (2006.01)

(52) U.S. Cl. ..... 399/117; 399/107; 399/130; 399/159

(58) Field of Classification Search ..... 399/107, 399/110, 116, 117, 130, 159, 167
See application file for complete search history.

(56) References Cited

U.S. PATENT DOCUMENTS

| | | | | |
|---|---|---|---|---|
| 5,652,647 | A * | 7/1997 | Yashiro et al. | 399/111 |
| 5,825,472 | A * | 10/1998 | Araki et al. | 399/111 |
| 5,845,173 | A * | 12/1998 | Zogg et al. | 399/90 |
| 7,020,410 | B2 | 3/2006 | Zogg et al. | |

FOREIGN PATENT DOCUMENTS

| | | |
|---|---|---|
| JP | H01-032532 | 3/1989 |
| JP | H01-073292 | 6/1989 |
| JP | 5-119681 | 5/1993 |
| JP | 5-119682 | 5/1993 |
| JP | 5-303263 | 11/1993 |
| JP | 8-129285 | 5/1996 |
| JP | 8-305256 | 11/1996 |
| JP | 11-258951 | 9/1999 |
| JP | 11-352831 | 12/1999 |
| JP | 2000-181286 | 6/2000 |
| JP | 2001-92306 | 4/2001 |
| JP | 2001-356638 | 12/2001 |
| JP | 2004-77913 | 3/2004 |
| JP | 2007-25347 | 2/2007 |
| JP | 2007-512574 | 5/2007 |

OTHER PUBLICATIONS

Japanese Office Action dated Jun. 15, 2010, together with English-language translation.

* cited by examiner

*Primary Examiner* — David Porta
*Assistant Examiner* — Jessica L Eley
(74) *Attorney, Agent, or Firm* — Scully, Scott, Murphy & Presser, PC

(57) ABSTRACT

A photosensitive body for electro-photography includes a photosensitive drum, a shaft, and a contact segment. The photosensitive drum includes a drum body that has a cylindrical shape, electrical conductivity, and an outer peripheral surface, and a photosensitive layer that is formed on the outer peripheral surface. The photosensitive drum is rotatable about a central axis of the drum body. The shaft penetrates through the drum body and extends along the central axis. The photosensitive drum is rotatable relative to the shaft. The contact segment is interposed between the photosensitive drum and the shaft to electrically connects the shaft and the drum body. The contact segment includes a pair of contact portions that forms a gap therebetween. The pair of contact portions is aligned in a direction perpendicular to the central axis while contacting with an outer circumferential surface of the shaft. A portion of the outer circumferential surface is placed in the gap.

6 Claims, 5 Drawing Sheets

PHOTOSENSITIVE BODY FOR ELECTRO-PHOTOGRAPHY

CROSS REFERENCE TO RELATED APPLICATION

This application claims priority from Japanese Patent Application No. 2008-191574 filed Jul. 25, 2008. The entire content of the priority application is incorporated herein by reference.

TECHNICAL FIELD

The present invention relates to a photosensitive body for electro-photography.

BACKGROUND

A photosensitive body is used in an electro-photographic type image forming device, such as a copying machine, a printer and a facsimile, and includes a cylindrical electrically conductive drum body formed with a photosensitive layer at its outer peripheral surface, an electrically conductive shaft formed from metal rotatably supporting the electrically conductive drum body, and an electrically conductive contact member formed from metal (a grounding plate) for electrically connecting the electrically conductive drum body to the shaft by a sliding contact between the contact member and the shaft.

SUMMARY

Instability in electric conductivity between the shaft and the contact member results in degradation of image formation.

Such image degradation tends to occur due to deposition of oxide layer onto an outer peripheral surface of the shaft as a result of operation of the image forming device for a prolonged period of time. Stability in electric conductivity between the shaft and the contact member is lowered or degraded due to the deposition of the oxide layer, and thus, the image degradation occurs.

The contact member normally includes a contact portion in the form of a tongue-like shape. In such configuration, the contact portion is twisted when the photosensitive drum is assembled, and accordingly, the contact portion is not appropriately brought into contact with the shaft. Hence, electrical conductivity between the shaft and the contact member may be destabilized.

In view of the foregoing, it is an object of the invention to provide a photosensitive body for electro-photography having a simplified structure capable of providing stabilized electric conductivity between the shaft and the contact member, to ensure image formation with high quality.

This and other objects of the present invention will be attained by providing a photosensitive body for electro-photography including a photosensitive drum, a shaft, and a contact segment. The photosensitive drum includes a drum body that has a cylindrical shape, electrical conductivity, and an outer peripheral surface, and a photosensitive layer that is formed on the outer peripheral surface. The photosensitive drum is rotatable about a central axis of the drum body. The shaft penetrates through the drum body and extends along the central axis. The shaft has an outer circumferential surface. The photosensitive drum is rotatable relative to the shaft. The contact segment is interposed between the photosensitive drum and the shaft to electrically connects the shaft and the drum body. The contact segment includes a pair of contact portions that forms a gap therebetween. The pair of contact portions is aligned in a direction perpendicular to the central axis while contacting with the outer circumferential surface. A portion of the outer circumferential surface is placed in the gap.

DETAILED DESCRIPTION

A photosensitive body for electro-photography according to an embodiment of the invention will be described with reference to accompany drawings.

<Structure of the Photosensitive Body>

Figure 1:
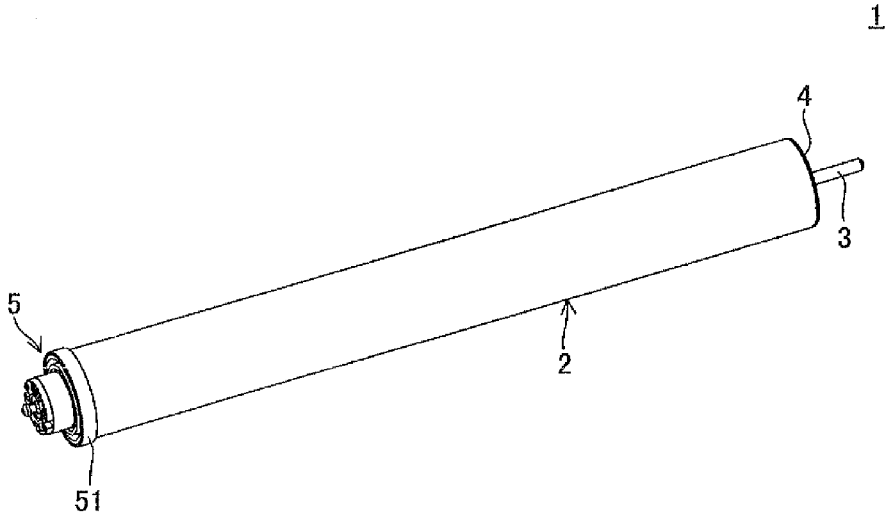
FIG. 1 is a perspective view of a photosensitive body for electro-photography showing an entire structure thereof according to an embodiment of the invention.
Figure 2:
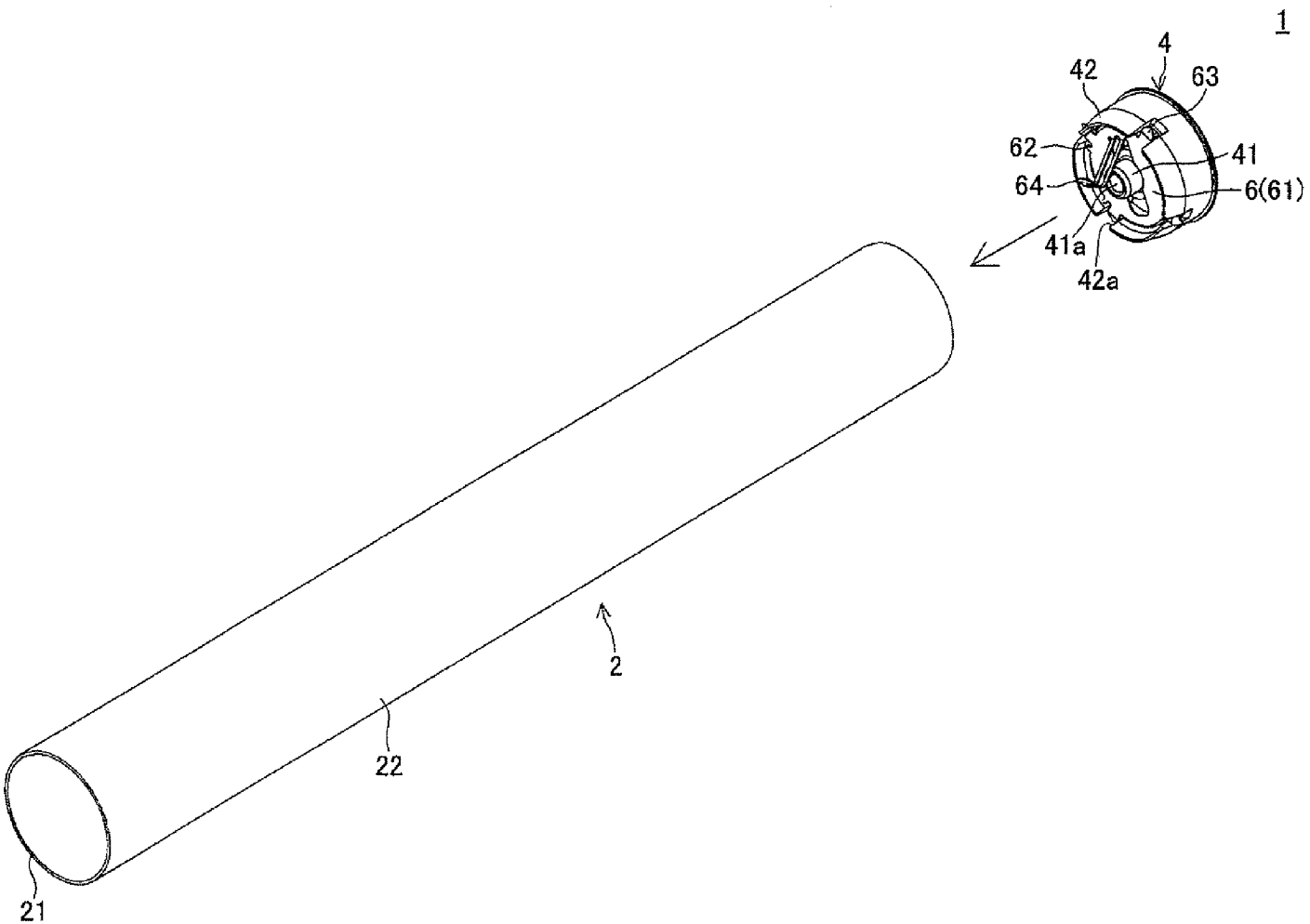
FIG. 2 is an exploded perspective view of the photosensitive body for electro-photography shown in FIG. 1, but some of portions therein are omitted.
Figure 3:
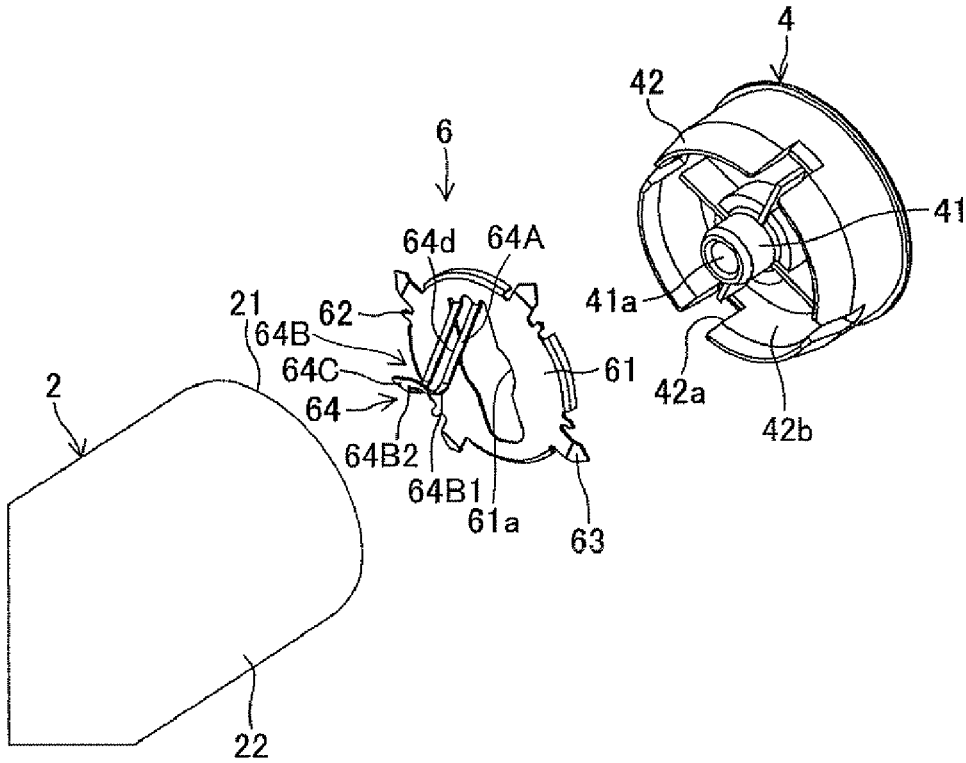
FIG. 3 is an enlarged perspective view (an exploded perspective view) showing a first flange and a conductive plate in the photosensitive body shown in FIG. 2.

As shown in FIGS. 1 and 2, the photosensitive body 1 includes a photosensitive drum 2, a shaft 3, a first flange 4, a second flange 5, and a conductive plate 6.

The photosensitive drum 2 includes a drum body 21 and a photosensitive layer 22. The drum body 21 is formed with a cylindrical tube made from aluminum, and has each open end in a longitudinal direction along a central axis of the photosensitive drum 2 (the drum body 21). The photosensitive layer 22 is formed of an organic photoconductor (OPC) layer having electrical conductivity when being irradiated with a laser beam having a predetermined wavelength, and is formed on an outer peripheral surface of the drum body 21.

The shaft 3 is an electrically conductive member formed in a cylindrical shape and made from stainless steel. The shaft 3 is aligned with the central axis of the photosensitive drum 2. In other words, the photosensitive drum 2 is disposed coaxially with the shaft 3. The photosensitive drum 2 is rotatable relative to the shaft 3 about the central axis.

The first flange 4 is force-fitted with one open end of the drum body 21. The second flange 5 is force-fitted with the other open end of the drum body 21. Each of the first flange 4 and the second flange 5 is a substantially cylindrical shape and made from synthetic resin. The first flange 4 and the second flange 5 are fixed to the photosensitive drum 2 so as not to be rotatable relative to the photosensitive drum 2.

The shaft 3 penetrates through the first end flange 4 and the second end flange. That is, the shaft 3 rotatably supports the photosensitive drum 2 through the first end flange 4 and the second end flange 5 functioning as bearing, so that the photosensitive drum 2, the first end flange 4 and the second end flange 5 are rotatable relative to the shaft 3.

<<Flange>>

The first flange 4 has an inner cylindrical portion 41 and an outer cylindrical portion 42. The inner cylindrical portion 41 is formed with a through-hole 41*a* through which the shaft 3 penetrates. The through-hole 41*a* has a diameter slightly greater than an outer diameter of the shaft 3. The inner cylindrical portion 41 rotatably supports the shaft 3. The through-hole 41*a* is formed by an inner peripheral surface of the inner cylindrical portion 41. The inner peripheral surface faces a shaft circumferential surface 3A of the shaft 3 when assembling. A clearance is formed between the inner peripheral surface forming the through-hole 41*a* and the shaft circumferential surface 3A, so that the first flange 4 can be smoothly rotated relative to the shaft 3.

The outer cylindrical portion 42 is provided to surround an outer peripheral surface of the inner cylindrical portion 41 at an outer side of the inner cylindrical portion 41. The outer cylindrical portion 42 is of a cylindrical shape, and has an outer diameter substantially the same as an inner diameter of the drum body 21 of the photosensitive drum 2. The outer diameter of the outer cylindrical portion 42 has predetermined fitting tolerance with respect to the inner diameter of the drum body 21. The outer cylindrical portion 42 is force-fitted with one open end of the drum body 21 so as to be fixed to the photosensitive drum 2.

Further, the outer cylindrical portion 42 has an axially inner end portion in which a plurality of U-shaped notches 42*a* (specifically, four notches) are formed.

The second flange 5 is provided with a gear 51. The gear 51 has a disk-like shape. A combination of the photosensitive drum 2, the first flange 4 and the second flange 5 is driven to rotate by a driving source (not shown) through the gear 51. The gear 51 has a diameter greater than an outer diameter of the photosensitive drum 2.

The conductive plate 6 will be described with reference to FIGS. 3 to 6. The conductive plate 6 is an integral component and has a substantially disk-like shape. The conductive plate 6 is produced by punching and press-forming a phosphor-bronze plate. The conductive plate 6 is fixed to an inner side of the first end flange 4.

<<Conductive Plate>>

The conductive plate 6 has a circular portion 61. The circular portion 61 is of a substantially disk-like shape. The circular portion 61 is formed with a center hole 61*a* at a center portion thereof. The inner cylinder portion 41 of the first flange 4 penetrates through the center hole 61*a*. The circular portion 61 has an outer peripheral portion provided with a plurality of first engagement protrusions 62 (specifically, four protrusions) and a plurality of second engagement protrusions 63 (specifically, four protrusions) protruding radially outwardly.

The first engagement protrusions 62 are brought into engagement with an inner peripheral surface 42*b* of the outer cylindrical portion 42 of the first flange 4, so that the conductive plate 6 is fixed to the first flange 4. The second engagement protrusions 63 protrudes outward from the notches 42*a* formed in the outer cylindrical portion 42 when the conductive plate 6 is fitted with the first end flange 4, and are brought into engagement with the inner peripheral surface of the drum body 21. Electric conductivity between the drum body 21 and the conductive plate 6 can be made by engaging the second engagement protrusions 63 with the inner peripheral surface of the drum body 21.

<<<Contact Segment>>>

The conductive plate 6 has a contact segment 64 in the form of a leaf spring. The contact segment 64 is resiliently deformable and formed in a tongue-like shape. A widthwise direction of the contact segment 64 is perpendicular to the central axis of the photosensitive drum 2 and to a direction that the contact segment 64 extends. The contact segment 64 has a base end and a free end. The base end of the contact segment 64 is integrally formed with the circular portion 61 of the conductive plate 6. The free end of the contact segment 64 extends toward the shaft 3 so as to slidingly contact with the shaft circumferential surface 3A when the shaft 3 is inserted through the through-hole 41*a* while the first flange 4 and the conductive plate 6 are assembled to the photosensitive drum 2. Electric conductivity between the drum body 21 and the shaft 3 through the conductive plate 6 can be made by bringing the contact segment 64 into contact with the shaft circumferential surface 3A.

The contact segment 64 includes a base portion 64A, a contact portion 64B, and a correcting portion 64C. The base portion 64A is integrally formed with the circular portion 61 of the conductive plate 6. The base portion 64A extends from the circular portion 61 toward the shaft 3 with being inclined with respect to a plate defining the circular portion 61. The base portion 64A and the contact portion 64B are formed with a slit 64*d* extending along the direction that the contact segment 64 extends.

The contact portion 64B and the connecting portion 64C are positioned at the free end of the contact segment 64. The contact portion 64B is bent in a V-shape and has a first contact portion 64B1 and a second contact portion 64B2. The slit 64*d* is formed between the first contact portion 64B1 and the second contact portion 64B2. At apexes of the bend, the first contact portion 64B1 and the second contact portion 64B2 contact with the shaft circumferential surface 3A. Hence, a portion of the shaft circumferential surface 3A is placed in the slit 64*d* while the first contact portion 64B1 and the second contact portion 64B2 contact with the shaft circumferential surface 3A. Therefore, alignment between a central axis of the shaft 3 in a longitudinal direction and the slit 64*d* can be maintained.

The first contact portion 64B1 is aligned with the second contact portion 64B2 in the widthwise direction of the contact segment 64 with interposing the slit 64*d* between the first contact portion 64B1 and the second contact portion 64B2. That is, the first contact portion 64B1, the slit 64*d*, and the second contact portion 64B2 are aligned in this order along the shaft circumferential surface 3A. In other words, the first contact portion 64B1 and the second contact portion 64B2 are arranged to be brought into contact with the shaft circumferential surface 3A at the same position with respect to the central axis of the shaft 3. That is, the first contact portion 64B1 and the second contact portion 64B2 are positioned in a same plane perpendicular to the central axis of the shaft 3.

Figure 5:
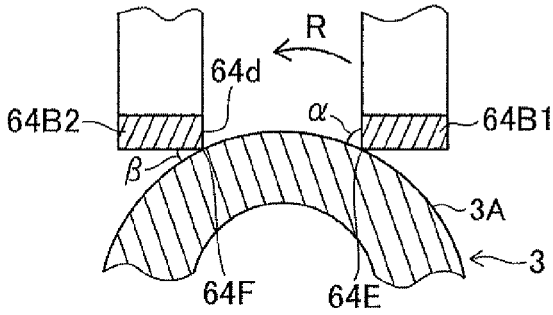
FIG. 5 is an enlarged cross-sectional view showing a shaft and first and second connecting portions in the photosensitive body according to the embodiment.

The contact segment 64 has each widthwise end, and the first contact portion 64B1 is located on one of the widthwise end while the second contact portion 64B2 is located on the other end. As shown in FIG. 5, the first contact portion 64B1 has a first inner edge 64E at an edge portion facing the slit 64*d* and the shaft 3. The second contact portion 64B2 has a second inner edge 64F at an edge portion facing the slit 64*d* and the shaft 3. The first inner edge 64E of the first contact portion 64B1 and the second inner edge 64F of the second contact portion 64B2 are configured to be in line contact with the shaft circumferential surface 3A.

Figure 4:
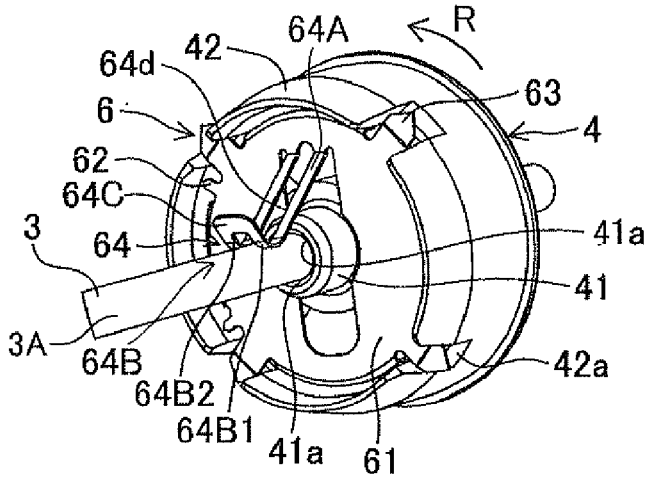
FIG. 4 is an enlarged perspective view showing the first flange and the conductive plate in the photosensitive body shown in FIG. 2.

When the first flange 4 to which the conductive plate 6 is fixed is rotated in a rotating direction R as shown in FIG. 4, the first contact portion 64B1 is located on an upstream side in the rotating direction R of the first flange 4, and the second contact portion 64B2 is located on a downstream side in the rotating direction R. As shown in FIG. 5, the first inner edge 64E of the first contact potion 64B1 contacts at a first acute angle α (large acute angle) to the shaft 3 and an inner edger portion of the second contact portion 64B2 contacts at a second acute angle β (small acute angle), that is larger than the first acute angle α, to the shaft 3. Hence, in the rotational state of the conductive plate 6, the second contact portion 64B2 slidingly moves on the shaft circumferential surface 3A with relative smoothness.

The connecting portion 64C connects between the first contact portion 64B1 and the second contact portion 64B2.

<Operation and Effects According to this Embodiment>

Operation and effects of the photosensitive body 1 for electro-photography according to this embodiment will be described with reference to FIG. 1 to FIG. 6.

<<Assembling>>

When assembling the photosensitive body 1 having the above structure, firstly, the conductive plate 6 is fixed to the first flange 4.

The outer peripheral portion of the conductive plate 6 is provided with the first engagement protrusions 62. The first engagement protrusions 62 are resiliently brought into fitting engagement with the inner peripheral surface of the outer cylindrical portion 42 of the first flange 4. The conductive plate 6 (the circular portion 61) is properly fixed to the first flange 4 in a predetermined manner. Such arrangement prevents the conductive plate 6 (the circular portion 61) from inclining relative to the first flange 4.

Next, the first flange 4 and the second flange 5 are force-fitted with the open ends of the photosensitive drum 2, respectively. Subsequently, the shaft 3 is inserted through the photosensitive drum 2 to which the first flange 4 and the second flange 5 are fixed.

The first contact portion 64B1 and the second contact portion 64B2 are urged to a substantially same direction toward the shaft circumferential surface 3A by resilient deformation of the contact segment 64. While the first contact portion 64B1 and the second contact portion 64B2 are brought into contact with the shaft circumferential surface 3A, the portion of the shaft circumferential surface 3A is placed in the slit 64*d*. According to the present embodiment, a gap defined by the slit 64*a* is formed between the first contact portion 64B1 and the second contact portion 64B2 of the contact segment 64. By placing the portion of the shaft circumferential surface 3A in the gap (slit 64*d*), the shaft 3 is guided to an appropriate position with respect to the contact segment 64. Hence, a contact state between the first contact portion 64B1 and the second contact portion 64B2, and the shaft circumferential surface 3A can be ensured properly.

When the photosensitive body 1 is assembled, the tongue-like shaped contact segment 64 is likely to be twisted, and insufficient contact between the contact segment 64 and the shaft circumferential surface 3A is likely to be caused. However, as described above, such insufficient contact can be prevented by the simple structure according to the above embodiment.

When the shaft 3 is inserted through the photosensitive drum 2, grease (lubricant) is applied to the first contact portion 64B1 and the second contact portion 64B2, in order to prevent noise caused by frictional contact between metal materials, that is, between the first contact portion 64B1 and the second contact portion 64B2, and the shaft 3. Electrically conductive grease is preferably used as the grease.

<<Movement of Photosensitive Drum>>

Figure 6:
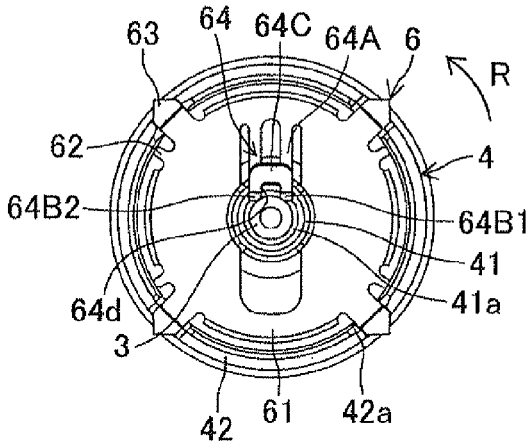
FIG. 6 is an enlarged side view showing the first flange and the conductive plate in the photosensitive body shown in FIG. 2.

When an image is formed, the gear 51 of the second flange 5 receives rotational driving force from the driving source of an image forming device (not shown), and thereby the photosensitive drum 2 is rotated relative to the shaft 3. In FIG. 6, the conductive plate 6 is rotated in a counter clockwise direction (i.e. the rotational direction R) relative to the shaft 3. Inside the photosensitive drum 2, the contact segment 64 is slidingly moved on the shaft 3.

In this circumstance, the first inner edge 64E of the first contact portion 64B1 contacts at the first acute angle α (large acute angle) to the shaft circumferential surface 3A. The first contact portion 64B1 and the second contact portion 64B2 are connected by the connecting portion 64C, so that sufficient rigidity of the first contact portion 64B1 and the second contact portion 64B2 can be ensured.

Even if contact load of the first contact portion 64B1 and the second contact portion 64B2 by the resilient deformation is not so large, foreign matter, such as incorporated materials into the grease, depleted materials of the grease and oxide layers, deposited around the shaft circumferential surface 3A can be readily removed (scraped off) by the first inner edge 64E of the first contact portion 64B1. Hence, the first contact portion 64B1 functions as "a cleaning portion" or "a foreign matter removing portion".

After the foreign matter on the shaft circumferential surface 3A has been removed by the first contact portion 64B1, the second inner edge 64F of the second contact portion 64B2 is brought into smooth contact with the shaft circumferential surface 3A at the second acute angle β (small acute angle). The second contact portion 64B2 slidingly smoothly moves on the shaft circumferential surface 3A, so that sufficient electric conductivity can be made between the second contact portion 64B2 and the shaft 3. Hence, the second contact portion 64B2 functions as "an electrically connecting portion". Electric connection can also be made by the first inner edge 64E of the first contact portion 64B1, concurrently with removing the foreign materials.

As described above, according to the present embodiment, sufficient electric conductivity between the shaft 3 and the contact segment 64 can be secured by a simplified structure and a relatively small contact load, and thus, ensures stabilized image formation with high quality.

While the invention has been described in detail with reference to the above embodiments thereof, it would be apparent to those skilled in the art that various changes and modifications may be made therein without departing from the scope of the claims.

For example, material of each component and method of forming each component are not limited to the above embodiment. Further, a portion formed by an integral component without any seam may be formed by combining separate portions.

Existence and number of the first engagement protrusions 62 and the second engagement protrusions 63, and number of the contact segment 64 are not limited to the above embodiment. Further, instead of the first engagement protrusions 62 or together with the first engagement protrusions 62, other engagement protrusions capable of engaging with the outer peripheral surface of the inner cylindrical portion 41 of the first flange 4 may be formed in the center hole 61*a*, that is, in an inner peripheral portion of the conductive plate 6.

A width of the slit 64*a* in the widthwise direction may be determined so as to retain a portion less than a half of the shaft circumferential surface 3A (preferably, a portion less than one-forth of the shaft circumferential surface 3A) in the slit 64*a*.

Structures around the first contact portion 64B1 and the second contact portion 64B2 are not limited to the above embodiment.

Figure 7:
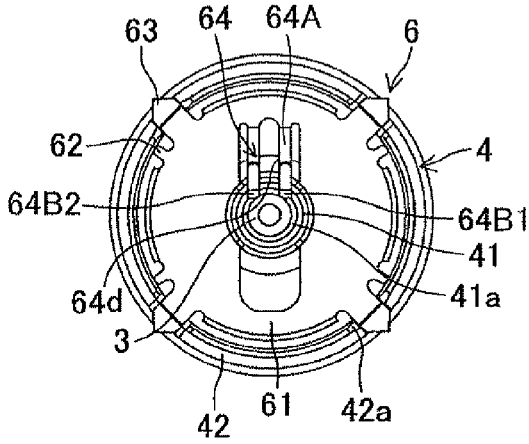
FIG. 7 is an enlarged side view showing a structure of the conductive plate shown in FIG. 5 according to one modification of the invention.

As shown in FIG. 7, the first contact portion 64B1 and the second contact portion 64B2 may not be connected at their distal ends. In other words, the connecting portion 64C shown in FIGS. 4 and 5 may be omitted.

Figure 8A:
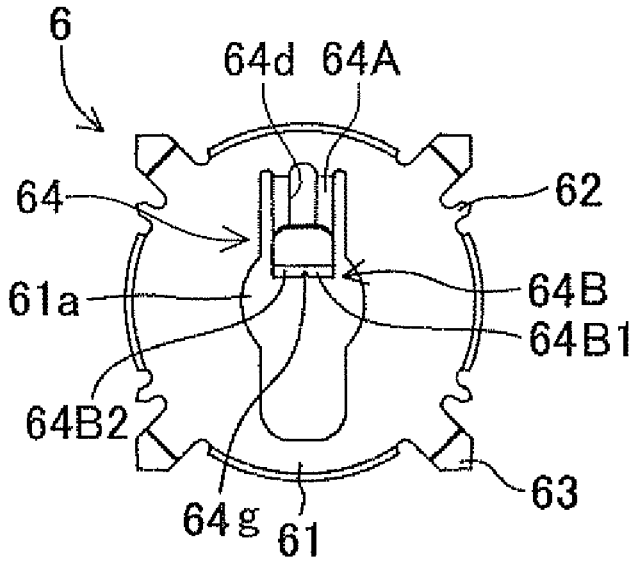
FIG. 8A is an enlarged side view showing a structure of the conductive plate shown in FIG. 5 according to another modification of the invention.
Figure 8B:
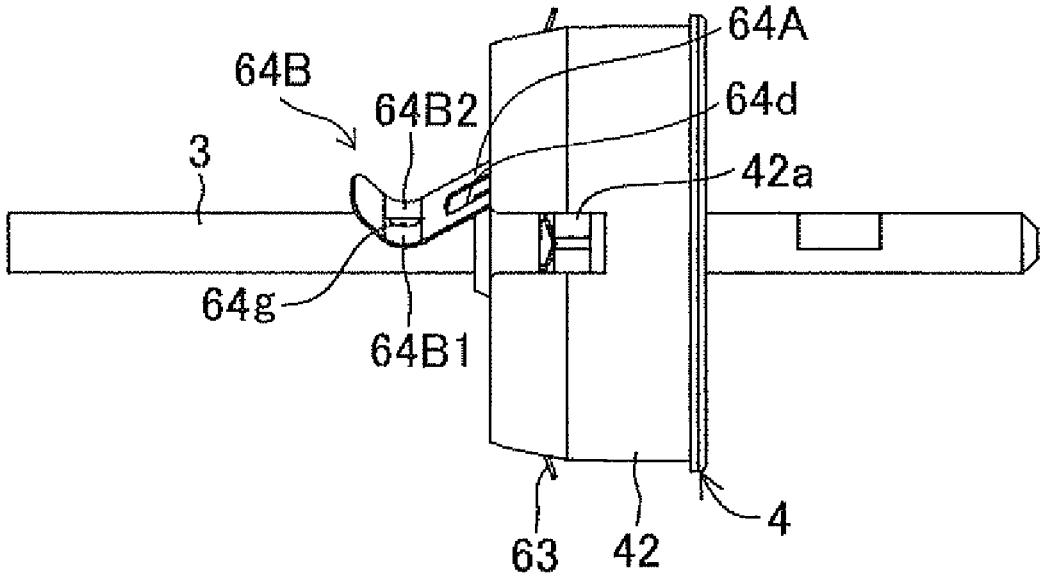
FIG. 8B is an enlarged side view of the first flange, to which the conductive plate shown in FIG. 7A is fixed, in a state that the shaft passes through the first flange.

As shown in FIGS. 8A and 8B, the first contact portion 64B1 and the second contact portion 64B2 may be aligned in the widthwise direction, interposing a concave portion 64*g* between the first contact portion 64B1 and the second contact portion 64B2. A portion of the shaft circumferential surface 3A is placed in the concave portion 64*g* while the first contact portion 64B1 and the second contact portion 64B2 contact with the shaft circumferential surface 3A. In this case, the slit 64*d* is formed in the base portion 64A of the contact segment 64, but the slit 64*d* may not be formed in the contact portion 64B.

The first contact portion 64B1 and the second contact portion 64B2 may be formed at a portion near the base end rather than in the free end of the contact segment 64.

Further, although the first contact portion 64B1 and the second contact portion 64B1 are configured to be in line contact with the shaft circumferential surface 3A according to the above embodiment, the first contact portion 64B1 and the second contact portion 64B1 may be configured to be in surface contact with the shaft circumferential surface 3A.

Further, if the photosensitive drum 2 is rotated in a reverse direction of the above, functions of the first contact portion 64B1 and the second contact portion 64B2 are interchanged.

What is claimed is:

1. A photosensitive body for electro-photography comprising:

a photosensitive drum that comprises a drum body that has a cylindrical shape, electrical conductivity, and an outer peripheral surface, and a photosensitive layer that is formed on the outer peripheral surface, the photosensitive drum being rotatable about a central axis of the drum body;

a shaft that penetrates through the drum body and extends along the central axis, the shaft having an outer circumferential surface, the photosensitive drum being rotatable relative to the shaft; and a contact segment that is interposed between the photosensitive drum and the shaft to electrically connects the shaft and the drum body and comprises a pair of contact portions that forms a gap therebetween, the pair of contact portions being aligned in a direction perpendicular to the central axis while contacting with the outer circumferential surface, a portion of the outer circumferential surface being placed in the gap such that the pair of contact portions forms the electrical connection between the shaft and the drum, each of the pair of contact portions has an inner edge that faces the gap and shaft such that only each of the inner edges contacts the outer circumferential surface of the shaft.

2. The photosensitive body according to claim 1, wherein the contact segment is made of a leaf spring and comprises a bending portion, the pair of contact portions being positioned at apex of the bending portion, and wherein the pair of contact portions is urged toward the outer circumferential surface by resilient deformation of the contact segment.

3. The photosensitive body according to claim 1, further comprising a conductive plate that is interposed between the photosensitive drum and the shaft to electrically connects the shaft and the drum body and comprises a main portion contacting with the photosensitive body and the contact segment extending from the main portion toward the shaft, and wherein the gap is a slit extending in a direction in which the contact segment extends.

4. The photosensitive body according to claim 1, wherein the contact segment has a free end, the pair of contact portions is located at the free end.

5. The photosensitive body according to claim 4, wherein the each of the pair of contact portions has a distal end, the distal ends of the pair of contact portions being connected each other.

6. The photosensitive body according to claim 1, further comprising:

a flange that is fitted into one end of the drum body in a longitudinal direction along the central axis, the flange comprising an inner cylindrical portion through which the shaft penetrates and an outer cylindrical portion that is provided to surround the inner cylindrical portion at an outer side of the inner cylindrical portion and has an inner peripheral surface, and a conductive plate that is interposed between the photosensitive drum and the shaft to electrically connects the shaft and the drum body and comprises a main portion formed with a through-hole through which the inner cylindrical portion penetrates, a flange engagement portion protruding from the main portion to engage with the inner peripheral surface of the outer cylindrical portion, and the contact segment.

* * * * *